US005444360A

United States Patent [19]

Drinkwater

[11] Patent Number: 5,444,360

[45] Date of Patent: Aug. 22, 1995

[54] MAINTENANCE REDUCTION APPARATUS

[76] Inventor: Don L. Drinkwater, 235 Fiske St., Carlisle, Mass. 01741

[21] Appl. No.: 334,440

[22] Filed: Nov. 4, 1994

Related U.S. Application Data

[60] Continuation of Ser. No. 73,323, Jun. 7, 1993, abandoned, which is a division of Ser. No. 797,119, Nov. 22, 1991.

[51] Int. Cl.[6] ..... G05F 1/40; F04B 49/00

[52] U.S. Cl. ..... 323/265; 417/12

[58] Field of Search ..... 323/265, 271; 237/80; 137/59; 417/12

[56] References Cited

U.S. PATENT DOCUMENTS 4,298,165 11/1981 McKinley ..... 417/12
4,672,990 6/1987 Robillard ..... 137/59
4,750,472 6/1988 Fazekas ..... 126/351
5,155,289 10/1992 Bowles ..... 323/268
5,171,336 12/1992 Shulick ..... 55/271
5,240,179 8/1993 Drinkwater ..... 237/80

FOREIGN PATENT DOCUMENTS 62-29691 9/1988 Japan ..... 323/265

*Primary Examiner*—Steven L. Stephan
*Assistant Examiner*—Matthew V. Nguyen

[57] ABSTRACT

A method and an apparatus to reduce the maintenance required for equipment which is not operating for relatively long periods of time such as seasonal equipment. The invention turns the equipment on for a brief interval at fixed periods of time. This cycling of the equipment during normally non-operating periods of time helps to prevent problems which occur when equipment is left idle for relatively long periods of time.

4 Claims, 4 Drawing Sheets

MAINTENANCE REDUCTION APPARATUS

FIELD OF THE INVENTION

This is a continuation of application Ser. No. 08/073,323 filed Jun. 7, 1993 now abandoned which is a division of Ser. No. 07/797,119, Filed 1991 Nov. 22. The invention is related to the field of preventative maintenance. Although not limited to, the invention is particularly useful when used with a heating or cooling system. Such systems typically require maintenance before or during the time they are re-initiated for the heating or cooling season.

BACKGROUND OF THE INVENTION

Equipment which is left idle for relatively long periods of time suffers from physical failure due to the idle period. Such failure includes but is not limited to mechanical bearing failure due to the drying of lubricants, leaking of gases or fluids due to the drying of seals, blockage of liquid carrying conduits due to corrosion and other chemical processes and failure of electronic components due to chemical reaction inactivity for such long periods of time.

It is typical for such equipment to be serviced before being re-started up. Such service is costly and potentially environmentally harmfull due to the need in many cases to add additional solvents and chemicals such as Freon in an air conditioning system.

SUMMARY OF THE INVENTION

It is therefore an object of the invention to provide a method and apparatus which will minimize or eliminate the need to do maintenence on equipment which is left idle for periods of time before re-start up of the equipment.

This and other objects are achieved according to the invention by a device which cycles the system on for brief periods of time during the otherwise off period. Said device or controller can be programmed for specific on periods at specifically programmed intervals.

By way of example, the following decription shows how the invention can be used to minimize seasonal maintenance on a hot water heating system.

DETAILED DESCRIPTION

Figure 1:
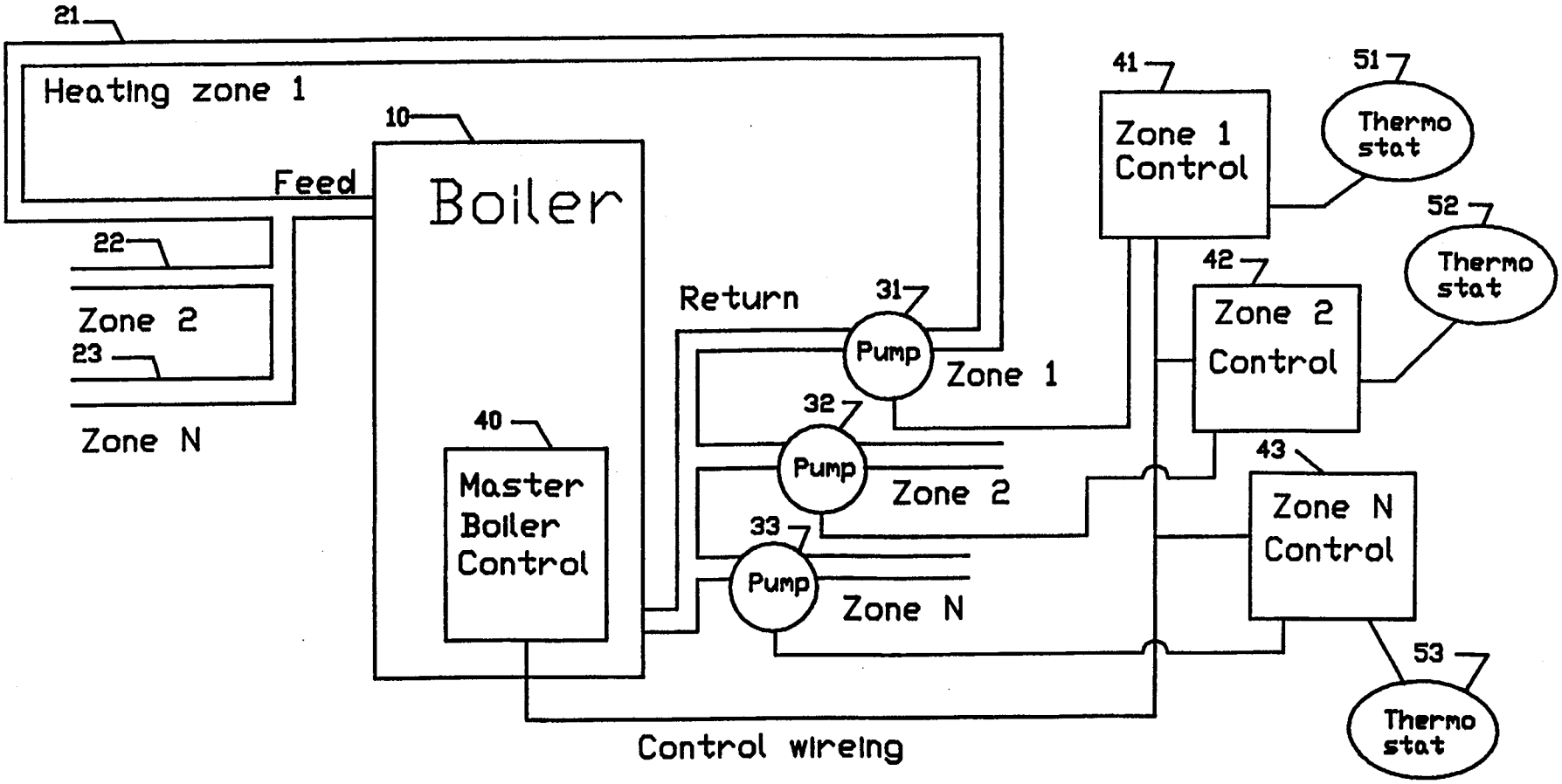
FIG. 1 shows a drawing of a heating system which a liquid is used to transfer heat energy to individual heating zones.

FIG. 1 shows an arrangement of a heating system by which liquid is used to transfer heat energy to a multiple of zones. A single zone system would be equally served by the invention. A boiler 10 is used to heat water or any suitable liquid. Pump 31 provides a method to move the liquid through the pipes 21 which service zone 1. Pump 32 is used in a similar way to move the liquid through the pipes 22 which service zone 2. Pump 33 provides a method to move the liquid through pipes 23 which service yet another zone N. (where N can be any number of zones) This system of pumps and pipes can be extended to service as many zones as required.

The system is controlled by a central master zone control and a multiple of slave controls corresponding to the number of zones and pumps. Each zone control is programed by a thermostat most typically located within the heated area a particular zone services. These components are the embodiment of a typical system. Multiple variations of the described system exist including but not limited to the use of zone solenoid type valves instead of multiple pumps.

Figure 2:
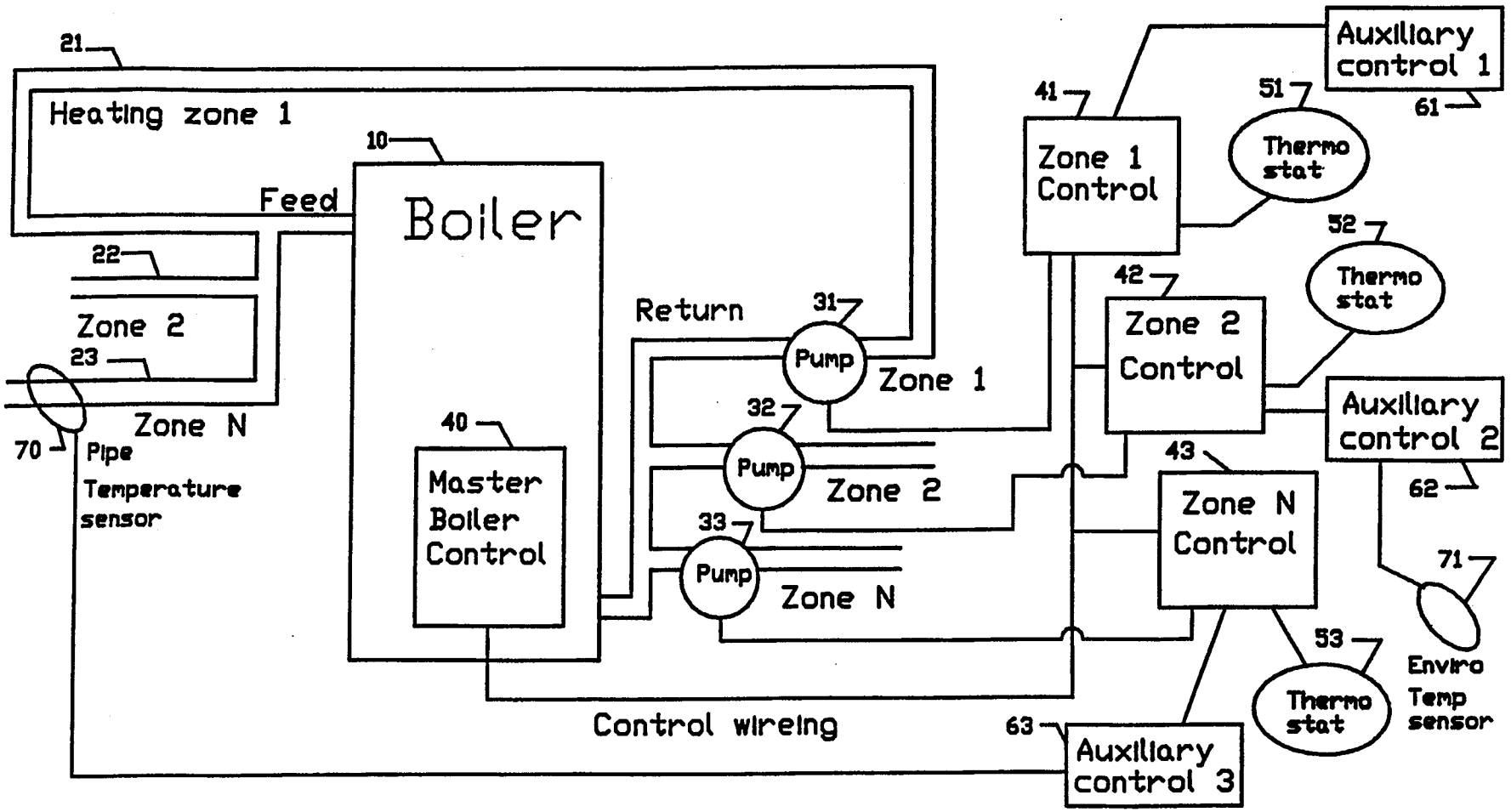
FIG. 2 shows a drawing of a system by which a liquid is used to transfer heat energy to individual zones with the improvements of the present invention.

FIG. 2 shows a similar system with the addition of the present invention. Auxiliary controllers 61, 62 and 63 are added along with optional heat sensors 70 and 71 if desired. One or more heat sensors can be connected to each auxiliary controller. The auxiliary controllers can be integrated if desired into either the master controller or zone controllers. The auxiliary controllers are programmed to cycle each individual zone and the boiler on and off during the non-heating system. The system could be configured such that a single controller cycled the entire system on and off. In addition, the auxiliary controllers can be designed to perform other functions such as providing a means to minimize the chance of the system from freezing during the heating season.

Figure 3:
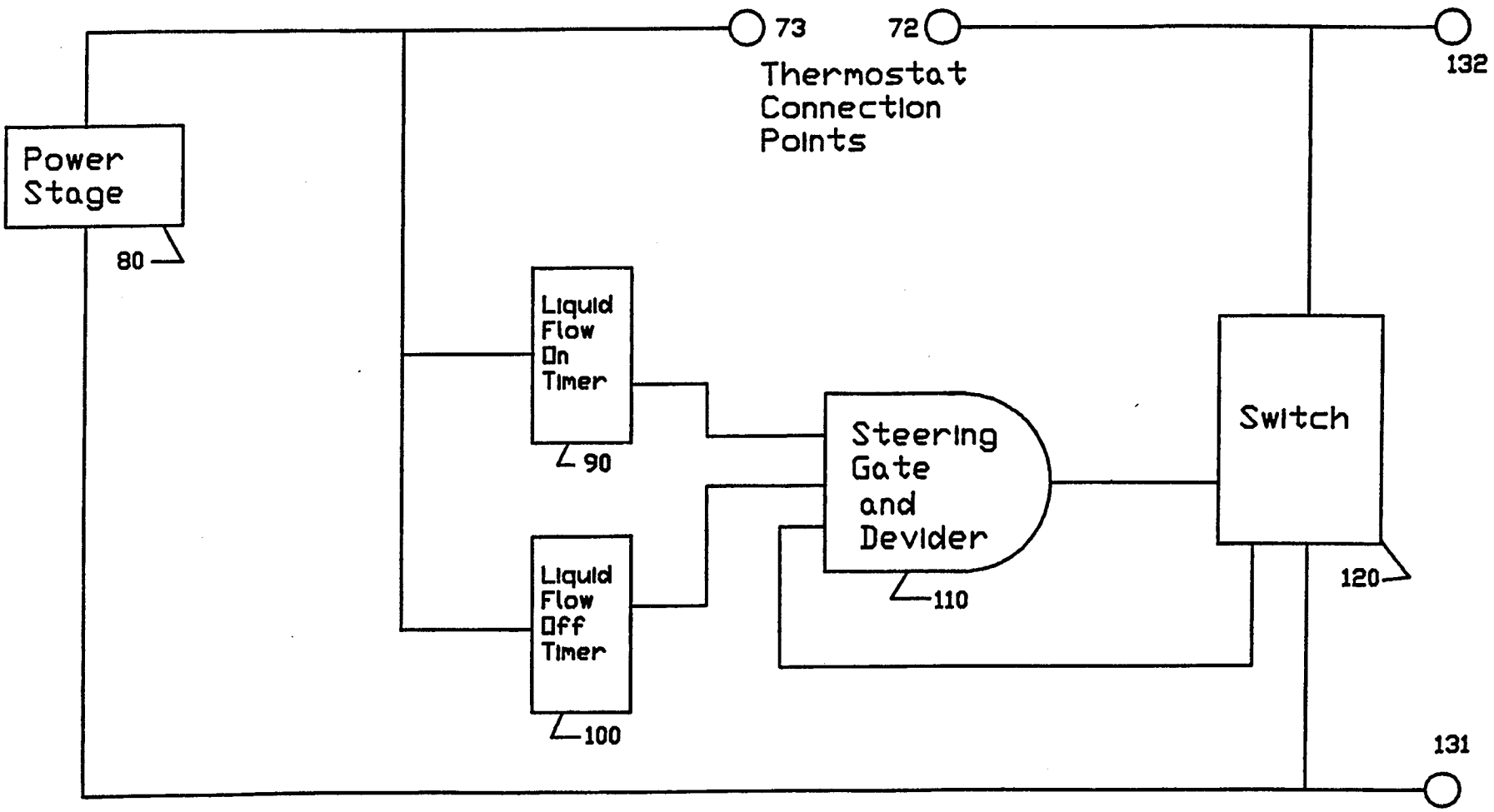
FIG. 3 is a block diagram of a control system which could be used to cycle the system on for brief time periods at specific intervals.

FIG. 3 is a block diagram of the auxiliary controller 61, 62, and or 63 according to the present invention. The major components are a power stage 80, a liquid flow on timer 90, a liquid flow off timer 100, a steering gate and time divider 110, a switch 120, a connection point 131 and a second connection point 132.

The power stage 80 provides the needed energy to the rest of the circuit components. The energy source can be constructed using storage components, power regulation components or any combination of both. The liquid flow on timer 90 controls the amount of time that liquid flows, thus placing the system in the on state. This timer can be adjustable. The liquid flow off timer 100 controls the amount of time the auxiliary controller 61, 62 or 63 is not requesting liquid to flow, thus maintaining the system in the off state. This time can also be made adjustable. The steering gate and time divider 110 divides the on and off timer increments to appropriate amounts and determines which timer is programming the switch. The switch 120 assumes a low impedance state to turn on the system and a high impedance state to turn off the system. The switch can also be designed to momentarily assume a high impedance for a short duration of time while in the low impedance state. Doing this allows the power stage to get bursts of energy and maintain power to the auxiliary controller.

Connection point 131 and connection point 132 are used to connect the auxiliary controller to the zone controller. Thermostat connection points 72 and 73 are used to connect the auxiliary timer to a thermostat 70 or 71 if desired. If used, the thermostat turns on the auxiliary controller when a potentially freezing condition exists. In a simpler configuration, connection points 72 and 73 are tied together. These points can also be tied to a switch used to manually turn the auxiliary timer on and off. A switch and thermostat connected in series and or parallel provides a variety of operator programmed options.

Figure 4:
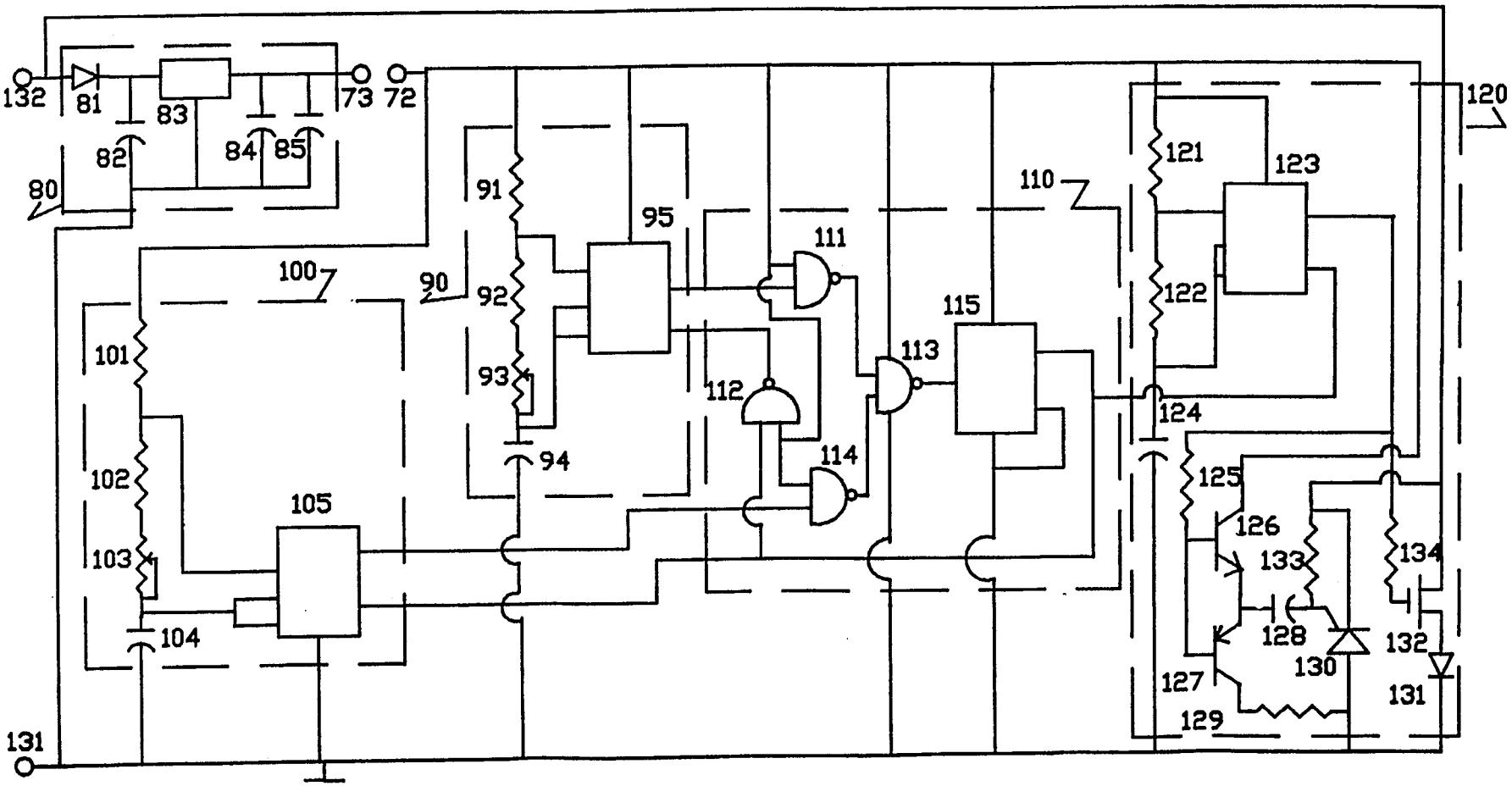
FIG. 4 is a schematic diagram of the control circuit shown in block diagram form in FIG. 2 constructed according to an embodiment of the present invention.

An embodiment of the auxiliary controller 61, 62 or 63 logic circuit according to the invention is shown in FIG. 4. The major components of the logic circuit are a power source 80, a timer 90 which can be set from two minutes to fifteen minutes days and which purpose is to turn the equipment on, a second timer 100 which can be set from fifteen minutes to multiple days and which purpose is to turn the equipment off, a steering circuit and timer divider 110 which determines which of the two timers is controlling and divides the time intervals appropriately so that the timers can operate at higher speeds to accommodate integrated timer circuit elements and a switching circuit 120 which is connected to controllers 61, 62 or 63 through contacts 131 and 132.

The power source 80 receives energy from a zone control 41, 42 or 43. Diode 81 and capacitor 82 rectify, filter and provide energy storage for the auxiliary controller. Integrated circuit (83) regulates the filtered voltage to approximately 12 volts. Capacitors (84) and (85) provide additional filtering as well as decoupling for the integrated circuits. Resistors 91 and 92 with potentiometer 93 and capacitor 94 program integrated circuit 95 to form a timer which turns on SCR 130 and FET 132. Potentiometer 93 provides for an adjustable turn-on time. Resistors 101 and 102 with potentiometer 103 and capacitor 104 program integrated circuit 105 to form a timer which turns off SCR 130 and FET 132. Potentiometer 103 provides for an adjustable turn-off time.

To minimize components, the circuits which make timers 95 and 105 are contained within the same integrated package. The same holds for gates 111, 112, 113 and 114. These gates form a steering circuit which activates and steers through the output from the appropriate timer. When the output of 115 is low, the turn on timer integrated circuit 95 is activated. When the output of 115 is high, the turn off timer integrated circuit 105 is activated.

Integrated circuit 115 divides the output of the turn on timer and turn off timer so that they can operate at much higher speeds than would otherwise be required. This minimizes the need for large and precise timer components. Timer 123, resistor 125, transistors 126 and 127, capacitor 128 and resistor 133 form a driving circuit for SCR 130. Timer 123, and resistor 134 form a driving circuit for FET 132. Diode 131 prevents current from flowing in a reverse direction through FET 132.

The switching circuit 120 contains a few unique features. Whenever the circuit receives a high signal from the steering gate and timer divide circuit 110, switching circuit 120 begins to oscillate at 1 Khz with a 90% duty cycle. This oscillation and duty cycle perform two tasks. First the pulsing oscillations drive SCR 130 on through capacitor 128, resistor 133, transistors 126 and 127 and resistor 125. SCR 130 is required to conduct current during the negative one half cycle of a sine wave if such a sine wave is being sent to the auxiliary controller by the zone controller to be controlled. Second, these same pulsing oscillations drive FET 132 on for 90% of the time and off for 10% of the time. Doing this gives capacitor 82 a brief recharge through diode 81 in order to maintain power to the auxiliary controller. FET 132 conducts the positive one half sine wave if a sine wave is present or a DC current if a DC current is being sent to the auxiliary controller from the zone controller for control. In either case power is always maintained to the auxiliary controller. If this pulsing feature were not present, the auxiliary controller would either require an extremely large capacitor 82 or a battery.

When timer 123 oscillates the contacts 131 and 132 are put in a low impedance state by SCR 130 and FET 132. This serves to turn on the equipment through the respective zone controller and desired mechanical apparatus. SCR 130 and FET 132 are turned off whenever the output of timer 123 goes low.

What is claimed is:

1. A method to minimize the maintenance of heating equipment and cooling equipment, due to seasonal periods of non use, comprising the steps of:

(a) connecting to said equipment a timing device with a capability to turn said equipment on for an on time interval and off for an off time interval;

(b) programming said timing device for said on and off time intervals, such that said on time interval is very small compared to said off time interval; and, (c) turning said equipment on and off in sequence according to said programmed time intervals; comprising the steps of:

(i) directing a first pulse stream to an electronic divider through a gate means during said off time interval;

(ii) directing a second pulse stream to said electronic divider through a gate means during said on time interval; and, (iii) connecting the output of said electronic divider to an electronic circuit that can turn said equipment on and turn said equipment off.

2. The method according to claim 1 wherein the step of connecting the timing device with the capability to turn said equipment on and off whereby the equipment can conduct DC current or can conduct AC current includes the steps of:

(a) sending a high frequency set of pulses to a silicon controlled rectifier to conduct electricity during the negative half cycle of a sine wave; and, (b) sending a high frequency set of pulses to a field effect transistor to conduct electricity during the positive half cycle of a sine wave or to conduct direct current electricity.

3. The method according to claim 1 wherein the step of connecting the timing device with the capability to turn said equipment on and off further comprises the steps of:

(a) providing a high frequency set of pulses that allow said field effect transistor to turn off for brief periods of time during the positive half cycle of a sine wave or when conducting DC current; and, (b) charging an energy storage device during the time period when said field effect transistor is turned off such that said energy storage device can maintain the electronics of said timing device to continue to operate during said on time interval.

4. The method according to claim 1 wherein the step of programming the timing device for said on and off time intervals includes the steps of programming a first timer for a specific period of time to turn on said equipment and programming a second timer for a specific period of time to turn off said equipment.

* * * * *